United States Patent [19]

Fowkes

[11] 4,407,333

[45] Oct. 4, 1983

[54] BELTING FABRIC

[75] Inventor: Robert A. Fowkes, Newtown, Conn.

[73] Assignee: Uniroyal, Inc., New York, N.Y.

[21] Appl. No.: 276,396

[22] Filed: Jun. 22, 1981

[51] Int. Cl.[3] ..... D03D 11/00

[52] U.S. Cl. ..... 139/415; 139/426 R; 198/846; 474/267

[58] Field of Search ..... 139/408-415, 139/420 R, 426 R; 198/847, 846; 474/266, 267

[56] References Cited

U.S. PATENT DOCUMENTS

| | | | |
|---|---|---|---|
| 870,697 | 11/1907 | Stevenson | 139/408 |
| 3,537,488 | 11/1970 | Le Boeuf | 139/415 |

FOREIGN PATENT DOCUMENTS

| | | | |
|---|---|---|---|
| 163250 | 10/1933 | Switzerland | 139/415 |
| 18886 | of 1898 | United Kingdom | 139/408 |
| 1273528 | 5/1972 | United Kingdom | 139/415 |

*Primary Examiner*—James Kee Chi

*Attorney, Agent, or Firm*—Norbert P. Holler

[57] ABSTRACT

A belting fabric having enhanced longitudinal and transverse rigidity includes closely adjacent, substantially uncrimped, warp cords in upper and lower planar arrays, and substantially uncrimped weft cords in upper, lower and middle planar arrays alternating with the arrays of warp cords. The cord to cord spacing in the middle array of weft cords is half that in the upper and lower arrays of weft cords, each upper weft cord is located midway intermediate two adjacent lower weft cords and vice versa, and each middle weft cord is located midway intermediate an upper weft cord and an immediately adjacent lower weft cord. All five arrays of cords are tied together by a set of upper and a set of lower binder cords extending in pairs in the warp direction intermediate, respectively, selected pairs of adjacent ones of the upper and lower warp cords, each two upper binder cords being interlaced jointly with each upper weft cord and, intermediate each two adjacent upper weft cords, singly each with only a respective one of the two middle weft cords located intermediate those two adjacent upper weft cords, and each two lower binder cords being interlaced jointly with each lower weft cord and, intermediate each two adjacent lower weft cords, singly each with only a respective one of the two middle weft cords located intermediate those two adjacent lower weft cords. This abstract is not to be taken either as a complete exposition or as a limitation of the present invention, however, the full nature and extent of the invention being discernible only by reference to and from the entire disclosure.

5 Claims, 6 Drawing Figures

Figure 1:
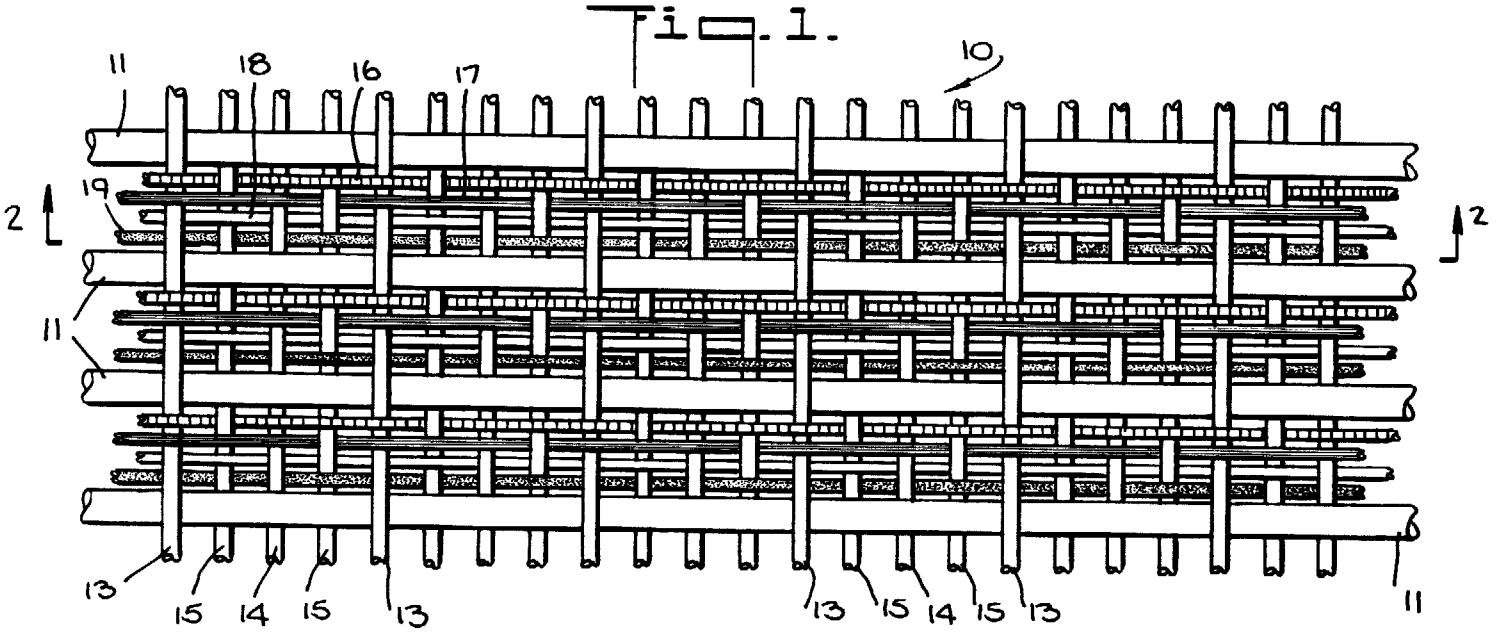
Figure 5:
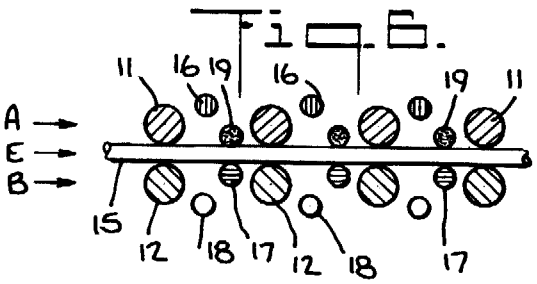
Figure 6:
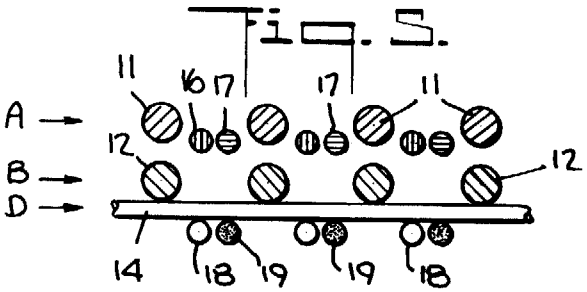

10
11
12
13
14
15
16
17
18
19

A
E
B
11
12
15
16
17
18
19

A
B
D
11
12
14
16
17
18
19

BELTING FABRIC

The present invention relates to belting fabrics for use in reinforced conveyor belts, and to conveyor belts incorporating such fabrics as the reinforcing means thereof.

Belting fabrics made entirely of synthetic fibers and generally including a plurality of warp cords, a plurality of weft cords extending transversely to the warp cords, and a plurality of binder cords extending in the warp direction between the warp cords and interlaced with the weft cords to lock them and the warp cords together, are well known. Representative fabrics of these types are shown in Rieger et al. U.S. Pat. No. 3,148,710 and LeBoeuf U.S. Pat. No. 3,537,488. The fabric construction disclosed in the Rieger et al. patent is characterized by a single layer of warp cords, two layers of transverse weft cords located above and below the layer of warp cords, respectively, and either two or three binder cords disposed between each two adjacent warp cords, with each binder cord passing in a specified alternating arrangement over and under specified ones of the upper and lower weft cords in such a fashion that the intersections of the binder cords between each two adjacent warp cords are located alternately above and below the mid-plane of the layer of warp cords. The fabric construction disclosed in the LeBoeuf patent, on the other hand, is characterized by two layers of warp cords and three layers of transverse weft cords located, respectively, above, between and below the layes of warp cords. The warp cords in each layer thereof are arranged in pairs of laterally abutting cords, with successive pairs being spaced relatively widely from each other, and with each pair of warp cords in each layer being offset laterally by one cord with respect to the corresponding pair of warp cords in the other layer. Two binder cords are provided between each two adjacent pairs of warp cords, one of such binder cords being interlaced with the upper and the middle weft cords, and the other of such binder cords being interlaced with the lower and the middle weft cords but in a 180° out of phase relation to the first-mentioned binder cord.

Belting fabrics of the aforesaid known types, by virtue of the respective constructions thereof, are characterized by certain degrees of tensile strength, longitudinal and transverse flexibility, and fastener pull-out strength (resistance to the pulling out of mechanical fasteners which may be used, for example, to join the ends of a length of conveyor belting reinforced by such a fabric to one another to complete an endless conveyor belt, or to secure buckets or the like to the conveyor belting). For some applications, however, the degrees of flexibility characterizing the known belting fabrics may turn out to be too high, that is to say it may be desirable to have a fabric possessed of greater longitudinal and transverse rigidity or resistance to flexing than is afforded by the known fabrics.

It is an object of the present invention, therefore, to provide a novel and improved belting fabric construction, which incorporates some of the features of the Rieger et al. and LeBoeuf fabric constructions (to which end the disclosures of those patents are hereby incorporated herein), and which is nevertheless characterized by a number of structural modifications that impart to it a higher degree of transverse and longitudinal rigidity or resistance to flexing and an enhanced resistance to pull-out of mechanical fasteners than are possessed by the Rieger et al. and LeBoeuf fabrics.

Generally speaking, the basic objectives of the present invention are achieved by a belting fabric construction which is characterized by the following basic features:

(a) a plurality of relatively closely adjacent, substantially uncrimped parallel warp cords is arranged in two parallel planar arrays (herein designated upper and lower, respectively);

(b) a plurality of substantially uncrimped parallel weft cords extending transversely to the warp cords is arranged in three parallel planar arrays (herein designated upper, lower and middle, respectively), the upper array of weft cords and the lower array of weft cords being located, respectively, above the upper array of warp cords and below the lower array of warp cords at the exterior surfaces of the fabric, and the middle array of weft cords being located between the upper and lower arrays of warp cords;

(c) the spacing between adjacent weft cords in each of the arrays of weft cords is greater than the spacing between adjacent warp cords in each of the arrays of warp cords, the spacing between adjacent ones of the upper weft cords is substantially equal to the spacing between adjacent ones of the lower weft cords, and the spacing between adjacent ones of the middle weft cords is approximately one-half the spacing of adjacent ones of either the upper or the lower weft cords;

(d) each upper weft cord, viewed as lying in a vertical plane, i.e. a plane perpendicular to the general plane of the fabric, is located substantially midway intermediate two adjacent ones of the lower weft cords, also viewed as lying in vertical planes, and vice versa, and each middle weft cord, viewed as lying in a vertical plane, is located substantially midway intermediate an upper weft cord and a laterally immediately adjacent lower weft cord;

(e) a first plurality of pairs of binder cords (herein designated upper) and a second plurality of pairs of binder cords (herein designated lower) extend in the warp direction of the fabric, the pairs of upper binder cords passing, respectively, intermediate selected pairs of adjacent ones of the upper warp cords, and the pairs of lower binder cords passing, respectively, intermediate selected pairs of adjacent ones of the lower warp cords; and (f) the two binder cords of each pair of upper binder cords are interlaced jointly with each of the upper weft cords and, intermediate each two adjacent upper weft cords, singly each with only a respective one of the two middle weft cords located intermediate those two adjacent upper weft cords, and correspondingly the two binder cords of each pair of lower binder cords are interlaced jointly with each of the lower weft cords and, intermediate each two adjacent lower weft cords, singly each with only a respective one of the two middle weft cords located intermediate those two adjacent lower weft cords.

More particularly, the currently contemplated best mode of practicing the present invention provides a belting fabric construction characterized by the fact that, in each of the upper and lower arrays of warp cords, the aforesaid selected pairs of adjacent warp cords between which the respective pairs of binder cords are disposed, include all of the warp cords. Thus, in this embodiment of the invention a pair of upper binder cords is disposed between each two adjacent upper warp cords, and a pair of lower binder cords is disposed between each two adjacent lower warp cords. As in the case of the single layer of warp cords in the Rieger et al. fabric, in the fabric of the present invention the adjacent warp cords in each array thereof are disposed closely adjacent each other, being spaced a distance somewhat greater than but less than twice the compressed diameter of one binder cord. This allows the individual binder cords to pass between the adjacent warp cords but prevents any two binder cords at their points of intersection from being forced into the being pulled through the space between the associated two warp cords. All the cords are made of non-metallic, synthetic textile fiber filaments, preferably of such materials as nylon, polyester, glass fiber and aramid fiber. By virtue of its having multiple arrays of warp and weft cords, with the warp cords in each array closely adjacent one another and with all the warp and weft cords interlocked in the described manner by the multiple pairs of binder cords, for an equivalent weight the fabric construction of the present invention is characterized by a relatively higher beam strength both in the warp direction and the weft direction than either the Rieger et al. or the LeBoeuf fabric and thus has a higher longitudinal and transverse rigidity as well as better pull-out resistance.

Figure 2:
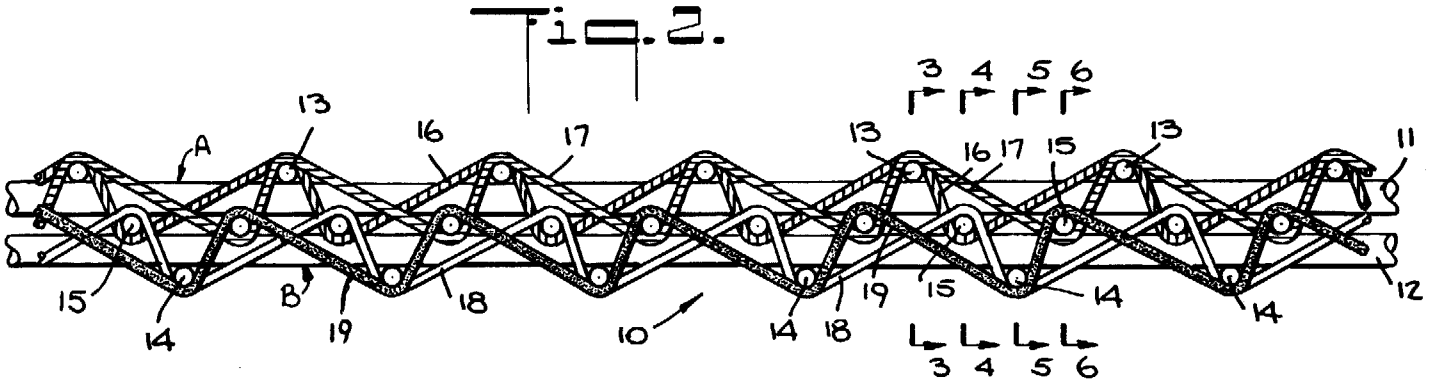
Figure 4:
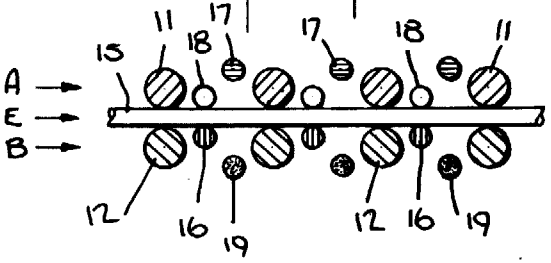
Figure 3:
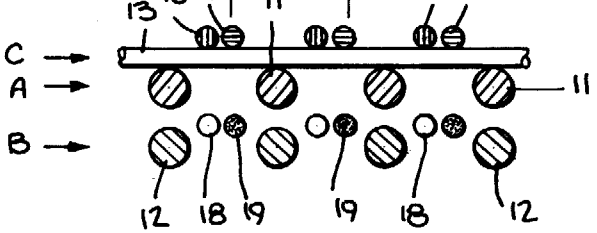

The foregoing and other objects, characteristics and advantages of the present invention will be more clearly understood from the following detailed description thereof, when read in conjunction with the accompanying drawings, in which:

FIG. 1 is a fragmentary, diagrammatic plan view of a belting fabric according to the preferred embodiment of the present invention, the fabric being shown in an idealized, greatly expanded form for the sake of clarity and comprehension;

FIG. 2 is a correspondingly diagrammatic sectional view taken along the line 2—2 in FIG. 1; and FIGS. 3, 4, 5 and 6 are, respectively, schematic illustrations of the warp/weft/binder cord relationships existing in the fabric at each of a series of repeat locations corresponding to the lines 3—3, 4—4, 5—5 and 6—6 in FIG. 2, these illustrations too being greatly enlarged and idealized for the sake of clarity and comprehension.

Referring now to the drawings in greater detail, a conveyor belting fabric 10 according to the present invention is seen to include two sets of parallel, substantially uncrimped warp cords 11 and 12, three sets of parallel, substantially uncrimped weft cords 13, 14 and 15 extending transversely to the warp cords, and two sets of pairs of binder cords 16–17 and 18–19 extending in the warp direction of the fabric. The warp cords 11 and 12 are arranged in respective parallel, planar, upper and lower arrays A and B, and the weft cords 13, 14 and 15 are arranged in respective parallel, planar, upper, lower and middle arrays C, D and E, with the upper array of weft cords 13 being located above the upper array A of warp cords 11, the lower array of weft cords 14 being located below the lower array B of warp cords 12, and the middle array of weft cords 15 being located between the upper and lower arrays A and B of warp cords 11 and 12. The entire assembly of warp and weft cords is bound together, in a manner to be more fully explained presently, by the binder cords, of which the pairs of binder cords 16 and 17 are disposed between respective adjacent ones of the upper warp cords 11, while the pairs of binder cords 18 and 19 are disposed between respective adjacent ones of the lower warp cords 12. Because of these relationships, the pairs of binder cords 16–17 and 18–19 are on occasion herein referred to, respectively, as the upper and lower binder cords.

As can best be visualized from FIGS. 1 and 2, the spacing between adjacent ones of the upper weft cords 13 in the array C is substantially equal to the spacing between adjacent ones of the lower weft cords 14 in the array D, and the spacing between adjacent ones of the middle weft cords 15 in the array E is approximately one-half the spacing of adjacent ones of either the upper or the lower weft cords. Moreover, each upper weft cord 13, viewed as lying in a vertical plane, i.e. a plane perpendicular to the general plane of the fabric 10, is located substantially midway intermediate two adjacent ones of the lower weft cords 14, also viewed as lying in vertical planes, and vice versa, and each middle weft cord 15, viewed as lying in a vertical plane, is located substantially midway intermediate an upper weft cord 13 and a laterally immediately adjacent lower weft cord 14. Contrary to what might be inferred from FIG. 1, however, the various weft cord spacings are all greater than the spacing between adjacent ones of the warp cords in each of the arrays A and B of warp cords and, proportionately, are relatively great. Here it will be understood that the primary purpose of the arrays of weft cords is not to enhance the warpwise rigidity of the fabric but rather to provide in effect a set of platforms for supporting and confining the arrays of warp cords. It is for this reason that the weft cords are spaced relatively far apart. On the other hand, since the arrays of warp cords are the primary means imparting the desired warpwise rigidity, tensile strength and pull-out resistance to the fabric, the warp cord spacing in each of the arrays A and B, again contrary to what might be inferred from FIGS. 1 and 3 to 6, is actually relatively small, being only slightly larger than the compressed diameter of one of the binder cords albeit somewhat less than twice the compressed diameter of an individual binder cord. The term "compressed diameter" as used herein denotes the diameter of a binder cord at its region of confinement between two adjacent warp cords. The warp cord spacing thus is also somewhat less than the normal diameter or thickness of an individual binder cord. Again contrary to what might be inferred from FIG. 1, therefore, each pair of upper binder cords 16–17 running between a given pair of upper warp cords 11 is actually located generally above the corresponding pair of lower binder cords 18–19 running between the pair of lower warp cords 12 underlying the said given pair of upper warp cords 11, so that in the completed fabric only the upper binder cords 16 and 17 are visible at the upper fabric surface while only the lower binder cords 18 and 19 are visible at the lower fabric surface. Finally, it should be noted that ideally each of the individual upper warp cords 11 in the fabric 10 should be disposed in substantially vertical alignment with, i.e. in the same vertical plane as (and hence in direct superposition to), the respective one of the lower warp cords 12, as illustrated in FIGS. 3 to 6. The loom on which the fabric is woven is actually designed to achieve such a result. In practice, however, during the weaving operation the upper warp cords (by virtue of their round cross-sectional shapes) tend to shift laterally somewhat relative to the equally round lower warp cords and to assume a position slightly out of vertical alignment therewith. It is nevertheless intended that the term "substantially vertical alignment" as used herein be interpreted as encompassing both a true vertical as well as a slightly offvertical relationship of the upper and lower warp cords.

The manner in which the binder cords tie the warp and weft cords into a unitary structure is best shown in FIGS. 1 and 2. Generally, the upper binder cords 16 and 17 are interwoven only with the upper and the middle weft cords, and the lower binder cords 18 and 19 are interwoven only with the lower and the middle weft cords. More particularly, in the preferred form of the invention, the two binder cords 16 and 17 of each upper pair of binder cords are interlaced jointly with each of the upper weft cords 13 and, intermediate each two adjacent upper weft cords, singly each with only a respective one of the two middle weft cords 15 located intermediate those two adjacent upper weft cords 13. Correspondingly, the two binder cords 18 and 19 of each lower pair of binder cords are interlaced jointly with each of the lower weft cords 14 and, intermediate each two adjacent lower weft cords, singly each with only a respective one of the two middle weft cords 15 located intermediate those two adjacent lower weft cords 14. At each repeat location 3—3, therefore (see FIGS. 2 and 3), both binder cords of each upper pair 16-17 are crossing jointly over an upper weft cord 13. From this point they first diverge and then reconverge, the binder cord 16 entering the fabric and crossing under a middle weft cord 15 at the position 4—4 (see also FIG. 4) and then returning to the next adjacent upper weft cord 13, and the binder cord 17 entering the fabric and crossing under the next adjacent one of the middle weft cords 15 at the position 6—6 (see also FIG. 6) and then returning to the same next upper weft cord 13. The region of intersection of the two upper binder cords 16 and 17 at the position 5—5 (see also FIG. 5) is located generally on the juncture plane between the upper warp cord array A and the middle weft cord array E.

Reverting to the location 3—3 once more, there the two binder cords of each lower pair 18-19 cross one another, their region of intersection being located generally on the juncture plane between the lower warp cord array B and the middle weft cord array E. After the binder cord 18 crosses over the middle weft cord 15 under which the upper binder cord 16 crosses, at the position 4—4 (see FIG. 4), the binder cord 18 converges with the other lower binder cord 19 as they return to the lower fabric surface at the position 5—5 to jointly cross under the lower weft cord 14 located midway intermediate the two upper weft cords 13 crossed by the upper binder cords 16 and 17. Thereafter, the two lower binder cords 18 and 19 diverge again, the binder cord 18 entering the fabric to cross (at a position which is a repeat of the position 4—4) over the middle weft cord 15 under which the upper binder cord 16 crosses, and the binder cord 19 entering the fabric to cross (at the position 6—6) over the middle weft cord 15 under which the upper binder cord 17 crosses.

With the two sets of binder cords woven in as described above under the requisite tension, the various arrays of warp and weft cords are secured into a composite structure in which any possibility of slippage between the warp and weft cords is effectively eliminated. The composite structure further, by virtue of the plural arrays of warp and weft cords and their dispositions in the respective arrays, has a beam strength in both the warp and the weft direction of the fabric which is greater than that found in the Rieger et al. and LeBoeuf fabrics and imparts to the fabric of the present invention, for an equivalent weight, a warp-wise and weft-wise rigidity and also a fastener pull-out strength substantially greater than those properties in the said known fabrics. The fact that the warp and weft cords are laid straight and in a substantially uncrimped state also enables the cord tensions to be more accurately controlled during the weaving operation, thereby enabling production of a belting fabric providing improved uniformity under the stresses imparted thereto when a belt incorporating such a fabric is in service. In this connection it should be noted that although the warp and weft cords are described as being substantially uncrimped, this is a condition that generally does not exist in actuality by virtue of the manner, well known to those skilled in the art, in which continuous filament cords are made. For the purposes of the present invention, however, it is contemplated that such crimp as does exist in the warp and weft cords used in the manufacture of the fabric will not exceed about 5%, and the term "substantially uncrimped" should thus be interpreted to include within its scope any degree of crimping not in excess of 5%.

The following are several examples of conveyor belting fabric constructions according to the present invention, which will illustrate the implementation of the invention more precisely.

EXAMPLE 1

| | |
|---|---|
| Weight, oz./sq. yd | 38.0 |
| Warp: | |
| Count, ends/inch | 32 |
| Yarn, ply | 1000 denier 4 ply polyester |
| Twist, turns/inch | 1.5 S |
| Crimp, percent | 3.0 |
| Yarn tensile, lbs. | 64 |
| Elongation at break, percent | 15 |
| Binder: | |
| Count, ends/inch | 64 |
| Yarn, ply | 1000 denier 1 ply polyester |
| Twist, turns/inch | Producer's twist |
| Crimp, percent | 20 |
| Yarn Tensile, lbs. | 16 |
| Elongation at break, percent | 15 |
| Weft: | |
| Count, ends/inch | 18 |
| Yarn, ply | 1000 denier 6 ply polyester |
| Twist, turns/inch | 1.5 S |
| Crimp, percent | 1.0 |
| Yarn tensile, lbs. | 96 |
| Elongation at break, percent | 15 |
| Average Break Tension, lbs./inch of width: | |
| Warp | 2000 |
| Binder | 1000 |
| Fabric Gauge, inches | 0.11 |

EXAMPLE 2

| | |
|---|---|
| Weight, oz/sq. yd. | 130 |
| Warp: | |
| Count, ends/inch | 22 |
| Yarn, ply | 1300 denier 24 ply polyester |
| Twist, turns/inch | 1.5 S |
| Crimp, percent | 5.0 |
| Yarn tensile, lbs. | 450 |
| Elongation at break, percent | 16 |
| Binder: | |
| Count, ends/inch | 44 |
| Yarn, ply | 1300 denier 2 ply polyester |

-continued

| | |
|---|---|
| Twist, turns/inch | 2.0 S |
| Crimp, percent | 44 |
| Yarn tensile, lbs. | 38 |
| Elongation at break, percent | 15 |
| Weft: | |
| Count, ends/inch | 13 |
| Yarn, ply | 1000 denier 9 ply polyester |
| Twist, turns/inch | 1.7 S |
| Crimp, percent | 1.0 |
| Yarn tensile, lbs. | 135 |
| Elongation at break, percent | 15 |
| Average Break Tension, lbs./inch of width: | |
| Warp | 9900 |
| Binder | 1600 |
| Fabric Gauge, inches | 0.25 |

EXAMPLE 3

| | |
|---|---|
| Weight, oz./sq. yd. | 40.0 |
| Warp: | |
| Count, ends/inch | 32 |
| Yarn, ply | 840 denier 5 ply nylon |
| Twist, turns/inch | 2.0 S |
| Crimp, percent | 3.0 |
| Yarn tensile, lbs. | 75 |
| Elongation at break, percent | 18 |
| Binder: | |
| Count, ends/inch | 64 |
| Yarn, ply | 840 denier 1 ply nylon |
| Twist, turns/inch | Producer's twist |
| Crimp, percent | 22 |
| Yarn tensile, lbs. | 15 |
| Elongation at break, percent | 18 |
| Weft: | |
| Count, ends/inch | 17 |
| Yarn, ply | 840 denier 7 ply nylon |
| Twist, turns/inch | 2.0 S |
| Crimp, percent | 1.0 |
| Yarn tensile, lbs. | 105 |
| Elongation at break, percent | 18 |
| Average Break Tension, lbs./inch of width: | |
| Warp | 2400 |
| Binder | 1750 |
| Fabric Gauge, inches | 0.12 |

EXAMPLE 4

| | |
|---|---|
| Weight, oz/sq. yd. | 78 |
| Warp: | |
| Count, ends/inch | 30 |
| Yarn, ply | ECH-15-1/3 ply fiberglass |
| Twist, turns/inch | 3.0 S |
| Crimp, percent | 2.0 |
| Yarn tensile, lbs. | 150 |
| Elongation at break, percent | 4 |
| Binder: | |
| Count, ends/inch | 60 |
| Yarn, ply | ECH-15-1/0 ply fiberglass |
| Twist, turns/inch | 2.0 S |
| Crimp, percent | 24 |
| Yarn tensile, lbs. | 50 |
| Elongation at break, percent | 4 |
| Weft: | |
| Count, ends/inch | 16 |
| Yarn, ply | 1500 denier 4 ply "Kevlar"* aramid |
| Twist, turns/inch | 3.0 S |
| Crimp, percent | 1.0 |
| Yarn tensile, lbs. | 260 |
| Elongation at break, percent | 4 |
| Average Break Tension, lbs./inch of width: | |

-continued

| | |
|---|---|
| Warp | 4500 |
| Binder | 3000 |
| Fabric Gauge, inches | 0.14 |

*"Kevlar" is the registered trademark of E. I. duPont de Nemours & Co. for its aromatic polyamide or aramid fiber.

As is well known, of course, a belting fabric is usually not employed as a belt per se but is first impregnated and covered, either on one or on both sides of the fabric and if desired also along the edges, with an elastomeric material. Suitable elastomeric materials for this purpose include natural rubber, synthetic rubbers such as polyurethane rubbers, styrene-butadiene rubbers, butyl rubber, acrylonitrile-butadiene rubbers, etc., and certain synthetic plastics such as flexible polyvinyl chloride. Prior to adhering the elastomeric covering to the belting fabric, the latter is usually processed for enhancing its adhesion to the covering material. Suitable adhesion-enhancing processes include (1) treating the greige fabric with a resorcinol-formaldehyde latex adhesive followed by the application of a friction and skim coat or a bank coat on a calender; (2) treating the greige fabric with a resorcinol-formaldehyde latex adhesive followed by a treatment with a rubber cement of a solvent type and the application of a skim or bank coat on a calender; and (3) treating the greige fabric with an isocyanate latex adhesive followed by the application of a skim or bank coat on a calender. Merely by way of example, the following is a typical natural rubber formulation which may be used to form the elastomeric covering material for the belt:

| Ingredient | Parts by weight |
|---|---|
| High modulus crepe | 100.0 |
| Light process oil | 2.7 |
| Stearic acid | 1.0 |
| Zinc oxide | 5.0 |
| Pine tar | 1.5 |
| Diphenylamine antioxidant | 1.5 |
| Carbon black | 40.0 |
| Wax | 0.5 |
| Phthalic anhydride | 0.3 |
| Benzothiazyl disulfide | 1.5 |
| Sulfur | 3.0 |
| | 157.0 |

Typically, the curing of a belt covered with such a natural rubber formulation applied in the form of a ⅛ inch thick top cover and a 1/16 inch thick bottom cover is effected at 280° F. in a flat press under a pressure of between 150 p.s.i. and 300 p.s.i. for a period of 30 minutes, or in a "Rotocure" apparatus using temperatures of 330° F. with a 50 lbs./inch band pressure at a speed of 2 feet/minute.

It will be understood that the foregoing description of a preferred embodiment of the present invention is for purposes of illustration only, and that the various structural features and relationships herein disclosed are susceptible to a number of modifications and changes none of which entails any departure from the spirit and scope of the present invention as defined in the hereto appended claims. For example, cords of other synthetic textile fiber filaments and physical constructions than those itemized herein can be used to make the fabric if they have physical properties suited to the conditions of stress to which the belting fabric will be subjected in use. Also, depending on the fabric properties sought to be attained, the binder cords may be disposed between other selected pairs of adjacent warp cords than those shown, e.g. the arrangement may be that the pairs of upper and lower binder cords are disposed only between every other two adjacent upper and lower warp cords, respectively, with the upper binder cords being disposed only between those upper warp cords which vertically overlie lower warp cords having no lower binder cords therebetween, and vice versa. It will also be understood that once the fabric has been woven, the warp, weft and binder cords exert compressive stresses on each other under the influence of the binder cords, as a result of which certain degrees of waviness come to exist in the various cords, but such waviness is not considered to be a crimp in the usual sense of that term, and its presence is not deemed to deprive the warp and weft cords of the state of being substantially uncrimped as hereinabove described.

What is claimed is:

1. A belting fabric, comprising:

upper and lower parallel planar arrays of relatively closely adjacent, substantially uncrimped, parallel warp cords;

upper, lower and middle parallel planar arrays of substantially uncrimped parallel weft cords extending transversely to said warp cords, said upper array of weft cords and said lower array of weft cords being located, respectively, above said upper array of warp cords and below said lower array of warp cords at the exterior surfaces of the fabric, and said middle array of weft cords being located between said upper and lower arrays of warp cords;

the spacing between adjacent weft cords in each of said arrays of weft cords being greater than the spacing between adjacent warp cords in each of said arrays of warp cords, the spacing between adjacent ones of said upper weft cords being substantially equal to the spacing between adjacent ones of said lower weft cords, and the spacing between adjacent ones of said middle weft cords being approximately one-half the spacing of adjacent ones of either said upper or said lower weft cords;

each of said upper weft cords, viewed as lying in a vertical plane, being located substantially midway intermediate two adjacent ones of said lower weft cords, viewed as lying in respective vertical planes, and vice versa, and each of said middle weft cords, viewed as lying in a vertical plane, being located substantially midway intermediate one of said upper weft cords and an immediately adjacent one of said lower weft cords;

a plurality of pairs of upper binder cords extending in the warp direction of the fabric and passing, respectively, intermediate selected pairs of adjacent ones of said upper warp cords, and a plurality of pairs of lower binder cords extending in the warp direction of the fabric and passing, respectively, intermediate selected pairs of adjacent ones of said lower warp cords;

the two binder cords of each of said pairs of upper binder cords being interlaced jointly with each of said upper weft cords and, intermediate each two adjacent upper weft cords, singly each with only a respective one of the two middle weft cords located intermediate those two adjacent upper weft cords, and the two binder cords of each of said pairs of lower binder cords being interlaced jointly with each of said lower weft cords and, intermediate each two adjacent lower weft cords, singly each with only a respective one of the two middle weft cords located intermediate those two adjacent lower weft cords.

2. A belting fabric as claimed in claim 1, wherein a respective pair of upper binder cords is disposed between each two adjacent upper warp cords, and a respective pair of lower binder cords is disposed between each two adjacent lower warp cords.

3. A conveyor belt comprising as a reinforcement the fabric of claim 1 or claim 2.

4. A belting fabric as claimed in claim 1 or claim 2, wherein the regions of intersection between each two associated upper binder cords are located substantially on the juncture plane between said array of upper warp cords and said array of middle weft cords, and the regions of intersection between each two associated lower binder cords are located substantially on the juncture plane between said array of lower warp cords and said array of middle weft cords.

5. A conveyor belt comprising as a reinforcement the fabric of claim 4.

* * * * *